US006923599B2

(12) United States Patent
Kelso

(10) Patent No.: US 6,923,599 B2
(45) Date of Patent: Aug. 2, 2005

(54) IN-GROUND LIFTING SYSTEM AND METHOD

(76) Inventor: Kenneth J. Kelso, 8702 Reamer St., Houston, TX (US) 77074

( * ) Notice: Subject to any disclaimer, the term of this patent is extended or adjusted under 35 U.S.C. 154(b) by 0 days.

(21) Appl. No.: 10/602,455

(22) Filed: Jun. 23, 2003

(65) Prior Publication Data

US 2004/0037653 A1 Feb. 26, 2004

Related U.S. Application Data

(60) Provisional application No. 60/390,973, filed on Jun. 24, 2002.

(51) Int. Cl.[7] ..... E02D 5/00; E02D 5/30

(52) U.S. Cl. ..... 405/230; 405/233; 405/247; 52/125.1; 254/93 R; 254/92; 187/203

(58) Field of Search ..... 405/230, 231, 405/232, 233, 235, 244; 52/125.1, 126.1, 126.5, 126.6, 292; 254/93 R, 92; 187/203, 205, 210

(56) References Cited

U.S. PATENT DOCUMENTS

| | | | | | |
|---|---|---|---|---|---|
| 3,634,985 | A | * | 1/1972 | Tipton | 52/126.1 |
| 4,081,992 | A | * | 4/1978 | Aurora et al. | 73/84 |
| 4,338,047 | A | * | 7/1982 | David | 405/230 |
| 4,695,203 | A | * | 9/1987 | Gregory | 405/230 |
| 4,995,204 | A | * | 2/1991 | Kelso | 52/126.1 |
| 5,116,355 | A | * | 5/1992 | Freeman, III | 405/230 |
| 5,176,472 | A | * | 1/1993 | Kinder | 405/230 |
| 5,228,807 | A | * | 7/1993 | Willcox, Jr. deceased | 405/232 |
| 5,399,055 | A | * | 3/1995 | Dutton, Jr. | 405/230 |
| 5,404,968 | A | * | 4/1995 | Fletcher | 254/92 |
| 5,573,083 | A | * | 11/1996 | Fletcher et al. | 187/205 |
| 5,709,286 | A | * | 1/1998 | Mead et al. | 254/92 |
| 5,800,094 | A | * | 9/1998 | Jones | 405/230 |
| 5,860,491 | A | * | 1/1999 | Fletcher | 187/203 |
| 6,193,442 | B1 | * | 2/2001 | May | 405/232 |
| 6,206,615 | B1 | * | 3/2001 | Adsb.o slashed.ll | 405/230 |
| 6,332,303 | B1 | * | 12/2001 | Saito | 52/741.14 |

FOREIGN PATENT DOCUMENTS

| | | | |
|---|---|---|---|
| GB | 2219021 | * 11/1989 | 405/230 |
| WO | WO 92/03621 | 3/1992 | E04B/1/16 |

* cited by examiner

*Primary Examiner*—Jong-Suk Lee
(74) *Attorney, Agent, or Firm*—Kenneth L. Nash

(57) ABSTRACT

An in-ground lifting system and method are provided that is operable for raising a structure and its foundation at least several feet. In one presently preferred embodiment, the method is utilized to raise the structure above any anticipated flood levels to thereby prevent future flooding of the structure. In a preferred embodiment, a plurality of excavations are formed underneath the foundation, such as with a hydro-excavator. A sleeve with seal members and hydraulic lines is installed and aligned within each excavation. Hardenable material is poured outside the sleeve to form a cylinder. Hardenable material is poured inside the sleeve to form a piston. Fluid is pumped through the hydraulic lines to lift the structure and the foundation.

17 Claims, 9 Drawing Sheets

IN-GROUND LIFTING SYSTEM AND METHOD

This application claims the benefit of U.S. Provisional Application No. 60/390,973 filed Jun. 24, 2002.

TECHNICAL FIELD

The present invention relates generally to lifting systems and, more particularly, to a lifting system that may be installed before or after the structure and its foundation is built and which is capable of lifting structures several feet or more.

BACKGROUND ART

Flooding affects a large number of houses every year. The repair cost of repeatedly fixing flooded houses, and/or buying out flooded houses, is quite high. It would be highly desirable to provide a means for lifting such houses high enough to be removed from the likelihood of any additional flooding for a cost that is less than the repair costs of repeat house flooding or buyout programs.

International Patent Application No PCT/US91/06401, published Mar. 5, 1992, to the present inventor Kenneth J. Kelso, and incorporated herein by reference, discloses a hydraulic self contained foundation leveling shim that is provided and placed in the upper end of a poured concrete foundation leveling pier before curing. Hydraulic hoses lead to the surface to allow hydraulic fluid to be pumped into and removed from the hydraulic chamber of the shim to raise or lower the foundation on the pier. A plurality of the piers and shims is used to level the foundation of a structure that has settled in unstable soil. A primary object is to provide an insertion means to respectively adjust a structure as it becomes uneven or unstable, by inserting matter which may comprise any solution of liquid, gas, and/or solid particles.

While the above described device provides an exemplary means for adjusting or leveling a house due to foundation shifts, it does not provide a means for lifting an already constructed house sufficiently high to remove the house from flooding hazards.

Consequently, there remains a need to provide an improved lifting system and method that may be utilized less expensively than traditional buyout or repair means to prevent future housing flooding. Those of skill in the art will appreciate the present invention which addresses the above and other problems.

SUMMARY OF THE INVENTION

An objective of the present invention is to provide an improved means for lifting a structure such as a house or building.

Another objective of the present invention is to provide a means for constructing piston assemblies capable of lifting a house or building by pouring hardenable material, such as cement, underneath the house or building.

These and other objectives, features, and advantages of the present invention will become apparent from the drawings, the descriptions given herein, and the appended claims. However, it will be understood that above-listed objectives and/or advantages of the invention are intended only as an aid in quickly understanding aspects of the invention, are not intended to limit the invention in any way, and therefore do not form a comprehensive or restrictive list of objectives, and/or features, and/or advantages.

Accordingly, a method is provided for lifting a structure. The structure may have a foundation supported on top of the soil. The method may comprise one or more steps such as, for instance, forming a plurality of spaced excavations underneath the foundation, mounting at least one form in each of the plurality of excavations, pouring hardenable material into the forms in the plurality of excavations to thereby form a plurality of piston assemblies within the excavations, each piston assembly comprising at least one piston and at least one cylinder moveable with respect to each other. The hardenable material affixes at least one of the piston or the cylinder with respect to the soil. Other steps may comprise and pumping fluid into the plurality of piston assemblies to lift the structure and the foundation with respect to the soil.

The excavations may be formed with a hydro-excavator. The pumped fluid may comprise hardenable material. Other steps may comprise permanently limiting the piston in position with respect to the cylinder for the plurality of piston assemblies within a range whereby a height of the foundation is adjustable within a range of movement after the structure is lifted. The method may further comprise partially filling a piston cylinder cavity with hardenable material and/or filling a portion of the piston cylinder cavity with particles, such as glass beads, that can be removed from or added to the piston cylinder at a time after lifting. Other steps may comprise monitoring a plurality of sensors while lifting the structure to minimize stresses on the foundation.

The invention provides a system for lifting a structure comprising one or more elements such as, for instance, a plurality of piston assemblies, the plurality of piston assemblies being positioned within excavations beneath the structure. At least one piston cylinder is provided for each of the plurality of piston assemblies. The piston cylinder is preferably formed from hardenable material that may be poured into the excavation. At least one piston may be provided for each of the plurality of piston assemblies. The piston may preferably be formed from hardenable material that may be poured into the excavation. At least one fluid line may be provided for pumping fluid (liquid, gas, particles, mixtures, hardenable materials, and combinations thereof) for each of the plurality of piston assemblies.

Other elements may include at least one sleeve for each of the plurality of piston assemblies. The sleeve may be mounted within the excavation whereby hardenable material may be poured outside the sleeve to form the piston cylinder, and hardenable material may be poured inside the sleeve to form the piston.

In another embodiment, a method comprises positioning a plurality of piston assemblies beneath the structure, each piston assembly having a length sufficient to lift the structure more than three feet, and operating the plurality of piston assemblies simultaneously to lift the foundation and the structure more than three feet with respect to the soil.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION OF PREFERRED EMBODIMENTS FOR CARRYING OUT THE INVENTION

Figure 1:
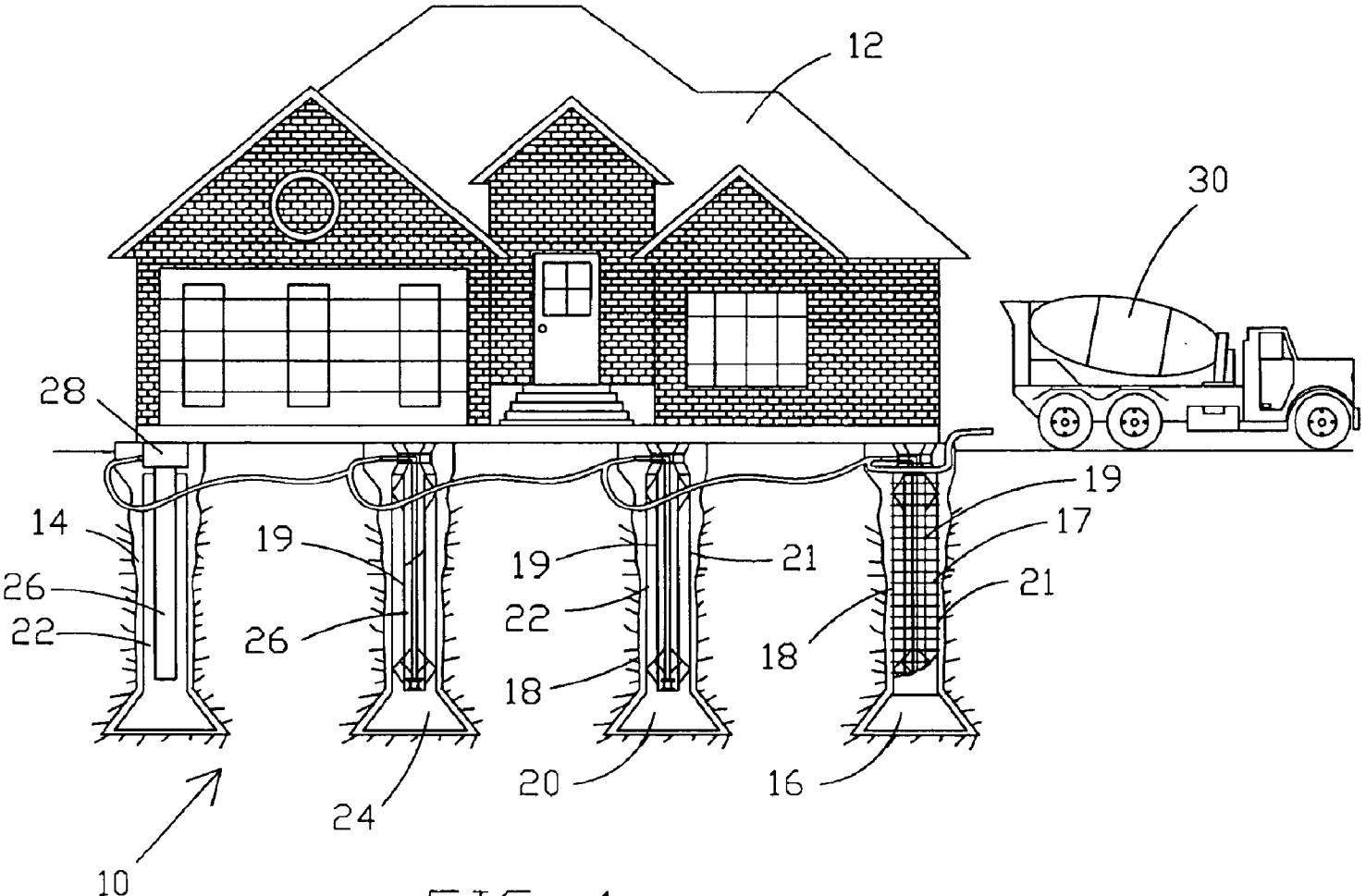
FIG. 1 is an elevational view, partially in section, showing installation of a plurality of in-ground lifting piston assemblies underneath a house in accord with the present invention.

Referring now to the drawings and, more particularly to FIG. 1 there is shown a presently preferred embodiment of an in-ground lifting assembly 10 in accord with the present invention in the process of being installed under house 12. The system may be utilized to lift structures such as houses, buildings, and the like by significant amounts. While many houses may require lifting only a few feet to be removed from the likelihood of further future flood damage, the system may be utilized to lift houses ten feet or more. The piston assemblies 14 are installed at the important load points in the foundation at a close enough spacing so that the entire foundation and house can be lifted safely. This requires sturdy, well supported piston assemblies 14, and overall controls for simultaneous operation and monitoring to closely control the elevation at all points throughout the lift. Moreover, the present invention may provide a built-in means for leveling and/or sensors for monitoring the level of the house at anytime in the future if the ground shifts should occur thereby permanently avoiding damage to foundations due to ground shifts. The resulting structure is sound and is designed to be able to withstand winds as required as per housing specifications or above.

FIG. 1 shows several piston assemblies in different stages of completion. In piston assembly 16, ground has been removed from the position below the house foundation to form excavation 18 in which piston assembly 16 is to be positioned. Rebar 17 and the like are preferably inserted in excavation 18 therein for strengthening purposes. At least one sleeve 19, such as a filament wound fiber glass sleeve as discussed in more detail hereinafter, is inserted and accurate aligned in within excavation 18 so that a piston lifting assembly formed within sleeve 19 will move in a predictable path. An outer sleeve 21 may also be utilized to provide more definition to the cylinder to be formed around the piston. Hardenable material, such as cement or other suitable hardenable material, is provided outside the sleeve. Whether outer sleeve 21 is utilized or not, this cement forms the piston cylinder. Additional hardenable material is also poured inside sleeve 19 to form a piston. Suitable seals are provided in the sleeve for the cement piston created therein, as discussed in further detail hereinafter. During the method of creation of piston assembly 16, the outer hardenable material is being poured outside of sleeve 19 to form the piston cylinder. If outer sleeve 21 is utilized then cement may be poured between sleeve 19 and 21 to form the piston cylinder, as well as outside of sleeve 21 to secure the cylinder within excavation 18.

The present invention may utilize various means for removing the dirt or material underneath a foundation so that the piston assembly can be constructed in the opening so created. Such methods may include but are not limited to hydro-excavation, mechanical augurs or digging machines, and the like. As an example, for a piston assembly sized to move a house by about four feet, each hole around the perimeter may typically require less than twenty minutes to dig with hydro-excavation equipment. Since the material in this method may be kept on location, as may be required to avoid regulations regarding adding or removing materials from a flood plain, the same material may be utilized later as needed for ramps, and the like, once the house is lifted.

Piston assembly 20 shows the piston assembly with the outer hardenable material already poured between liner 21 and 19 to thereby form the completed piston cylinder 22 of piston assembly 20. Cement may also be poured outside of liner 21 to secure piston assembly 20 within excavation 18.

Piston assembly 24 shows piston 26 being poured within sleeve 19 to thereby form the piston portion of piston assembly 24. After cementing, the lifting of the house may be accomplished within a short time, such as the following day. Hardeners, epoxies, and the like, may be utilized and mixed within mixing truck 30 to thereby permit fast hardening of the piston assembly assemblies.

Piston assembly 14 is completed with a piston and piston cylinder made of hardenable material such as cement. A head portion, or grout cup, may be separated from and poured to engage the bottom of the foundation and for supporting the hydraulic line inputs, jacks, hoses, or the like. In one embodiment a grout cup may be provided with walls that collapse, or otherwise designed, so that the hardenable material deforms to fill in uneven surfaces.

Figure 2:
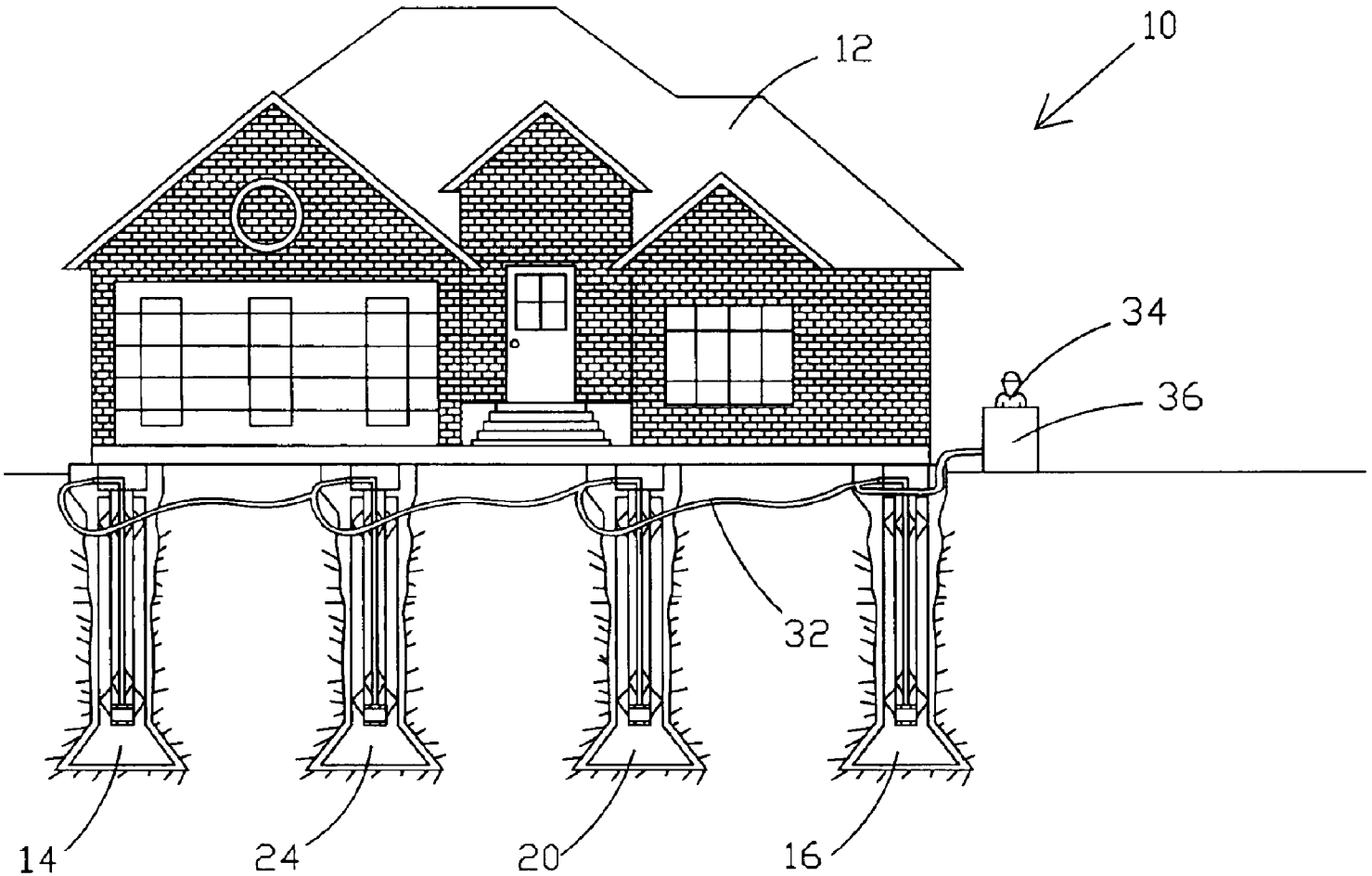
FIG. 2 is an elevational view, partially in section, showing interconnection of controls for simultaneous operation of the plurality of in-ground lifting piston assembly is in accord with the present invention.

In FIG. 2, the plurality of piston assemblies are manifolded together with hydraulic line 32. Lifting pressure in line 32 may be applied by operator 34 in hydraulic control 36. While this embodiment shows a single hydraulic line going to all the piston assemblies, it may be preferable to have a separate hydraulic line connection to each piston assembly, or to groups of piston assemblies, to thereby permit separate adjustment of each piston assembly or each group of piston assemblies. The connections may preferably permit both a selection between either operation in parallel of multiple piston assemblies or separate operation for particular piston assemblies on an as needed basis. Note that the hydraulic lifting fluid may itself be a hardenable fluid, or may be later replaced by a hardenable material to thereby provide a fixed structure. Note also, that hardenable material may be utilized with glass beads to permit future leveling adjustments without the need for reliance on hydraulic seals over long periods of time, as discussed hereinafter.

Figure 3:
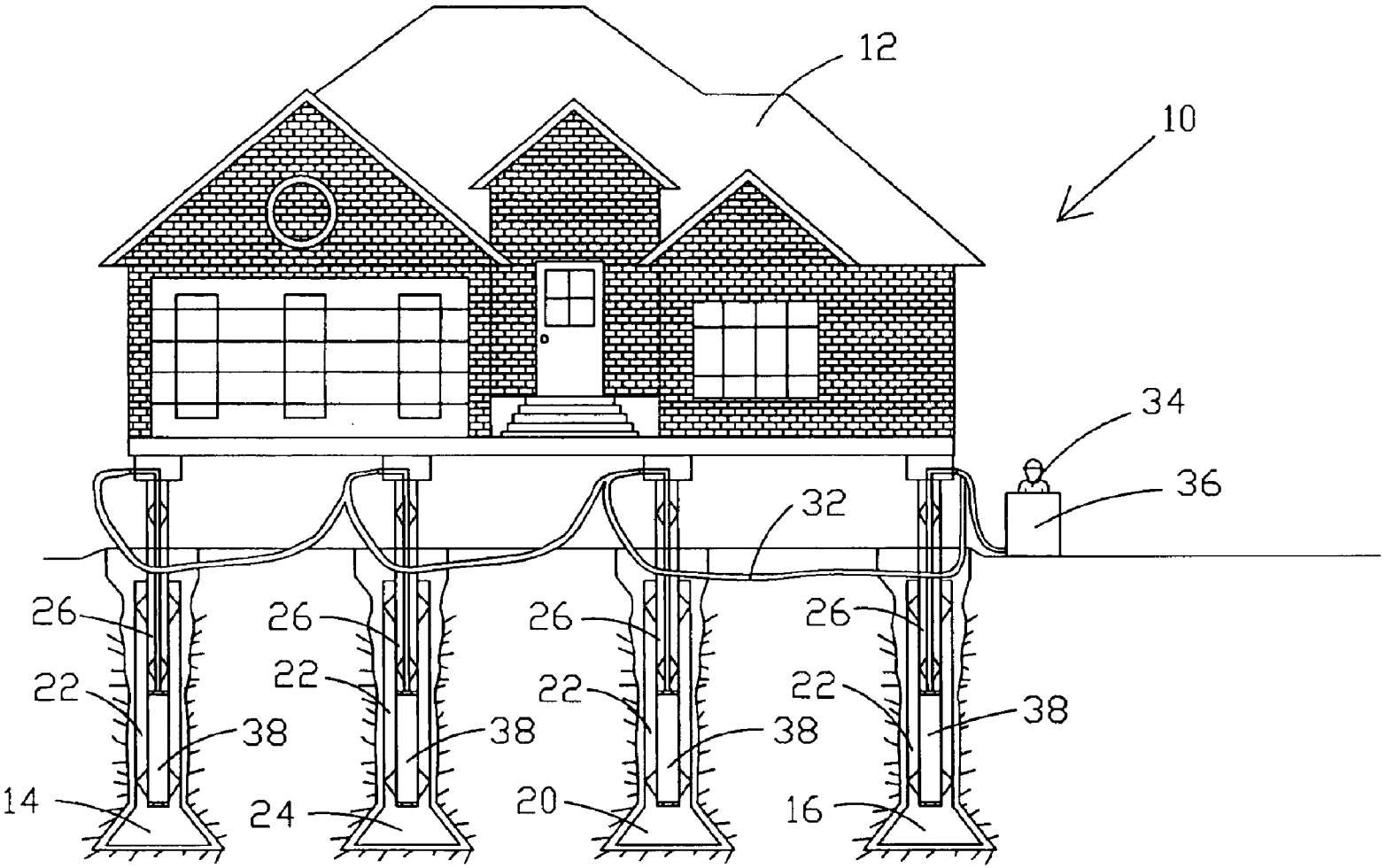
FIG. 3 is an elevational view, partially in section, showing the lifting pistons moving with respect to the in-ground cylinders as they simultaneously push the house upwardly in accord with the present invention.

FIG. 3 shows house 12 in the process of being raised. Hydraulic fluid creates pressure in chamber 38 formed within each cylinder 22 to thereby force the respective piston 26 upwardly. It will be understood that each piston 26 is moving upwardly with respect to its respective in-ground piston cylinder 22. The foundation is monitored as described above to accurately control the lift to minimize bending stresses applied to the foundation. The strongest portions of the foundation, such as the gray beam, are utilized for lifting to thereby maximize the foundation's ability to resist bending stresses applied to the foundation.

In one presently preferred embodiment, numerous sensors are utilized to maintain the pressures and lifting rates constant. Numerous sensors may be utilized including barametric sensors, laser sensors, elevational sensors, stress detectors, relative movement sensors, strain gages and the like. The sensors are utilized to monitor the foundation as it is lifted to thereby avoid the possibility of stresses that might otherwise damage the foundation. In response to indications of the sensors, which may have readouts at a central panel, the lift controls may be adjusted to minimize stresses. Thus, sensors may indicate a lifting pressure at each piston assembly, bending of the foundations, an elevation at sensor locations, piston assembly alignment indicators, and so forth, as desired as also discussed hereinafter.

Figure 4:
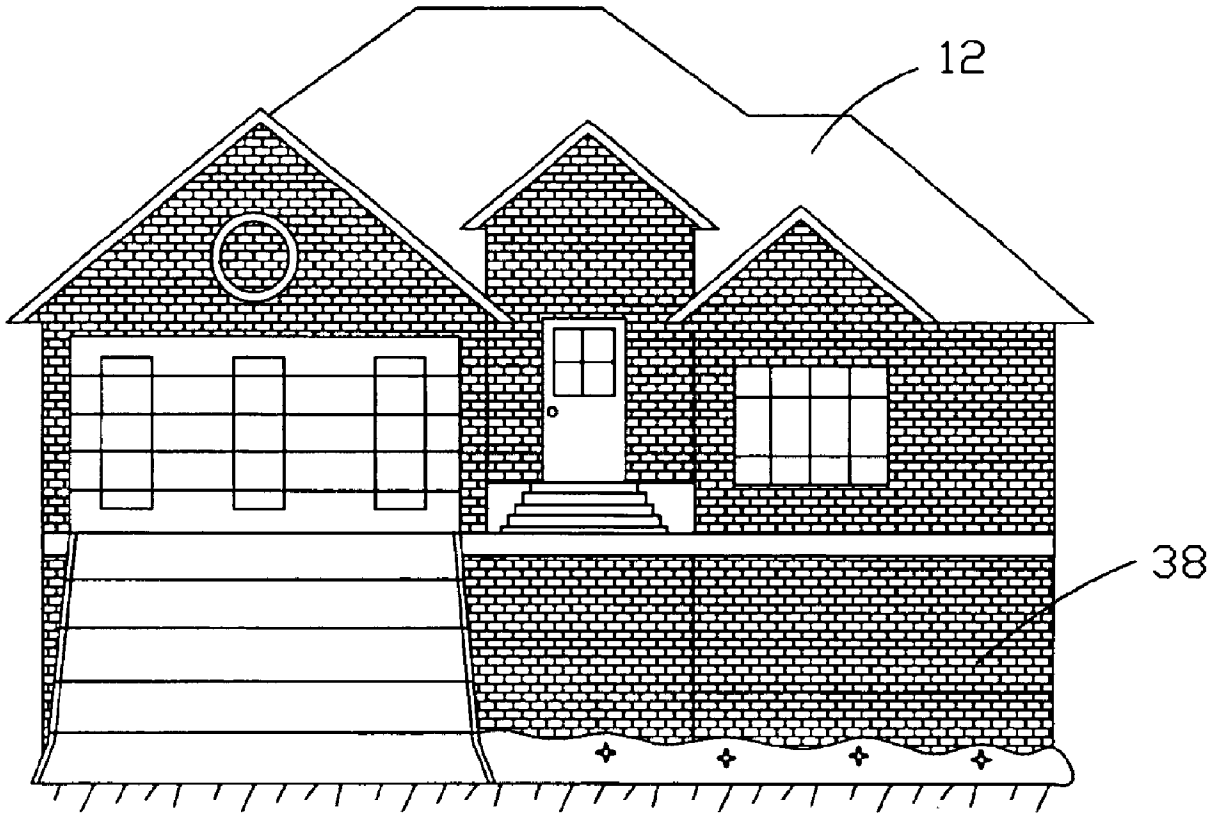
FIG. 4 is an elevational view showing one possible outer appearance of a house after a completed lifting operation in accord with the present invention.

FIG. 4 illustrates one possible means of finishing the house after completion of the lifting job. Walls 38 or other coverings may be added to cover the piston assemblies. Dirt used from excavating material for the piston assemblies may be used for ramps, driveways, steps, and the like.

FIG. 5 and FIG. 6 show various components of one possible embodiment of a piston lifting assembly in accord with the present invention with piston 26 in two different positions. In one preferred embodiment of the method, sleeve or cylinder liner 19, outer cylinder liner 21 seal sections 40 and 42, and hydraulic line 44 may be first positioned within excavation 18 formed within the soil as shown in FIG. 1. The means for vertically orienting sleeve or cylinder liner 19 and, if used, outer cylinder liner 21 may include various methods, some of which are discussed hereinafter. Cylinder liner 19 and outer cylinder liner 21 is oriented and fixed into position. Various types of supports may be utilized to fix the aligned position of cylinder liner 19 such as centralizers 46 and 48, braces, supports, and so forth. Rebar 17 may also be mounted between outer cylinder liner 21 and inner cylinder liner 19 for strengthening purposes. Cylinder liners 19 are sized with a sufficient diameter such that a plurality of piston assemblies formed by pouring hardenable material in the positions defined thereby will produce a lifting power sufficient for raising the structure.

In a presently preferred embodiment, a flexible membrane 52 is provided on the inside of inner cylinder liner 19. Flexible membrane 52 prevents contact between the cement poured to form piston 26 from contacting inner cylinder liner 19. Cylinder liner 29 is preferably a filament wound fiberglass sleeve. Membrane 52 becomes especially important for longer pistons because the forces created during curing of cement especially in longer pistons may otherwise score the inside of cylinder liner 19 causing the piston to seize up. Flexible membrane 52 comprises plastic material or the like. Preferably, the entire assembly of inner and outer cylinder liners 19 and 21, hydraulic line 44, membrane 52, rebar 17, seals 40 and 42, centralizers 46 and 48, and the like, may be assembled and inserted into excavation 18 for alignment.

Cylinder portion 22 of the piston assembly may then be poured using a suitable hardenable material selected to have a desired curing time. The integrity of the hardenable material, and any reinforcing material such as rebar 17, is selected to be sufficient to contain the hydraulic pressure necessary to provide the required lifting force. An enlarged base portion 50, if desired, may be provided on the bottom of the piston assembly as indicated or elsewhere where necessary for additional stability within less consolidated soils. Enlarged base portion 50 may be formed by providing an enlargement in the excavation in which the piston assembly is formed.

Piston 26 is then formed within the cylinder liner by pouring hardenable material therein. Membrane 52 may be utilized to prevent contact of cement with the inside surface of cylinder liner 19. Piston cap 28 may be formed separately, if desired, with a mold, form, or other means, and may preferably be poured in a way whereby it cures to engage the bottom of the foundation. Additional discussion of features of the piston may be shown in my previous PCT publication discussed above. However, that piston assembly is suitable only for lifting short distances for foundation leveling purposes.

Figure 5A:
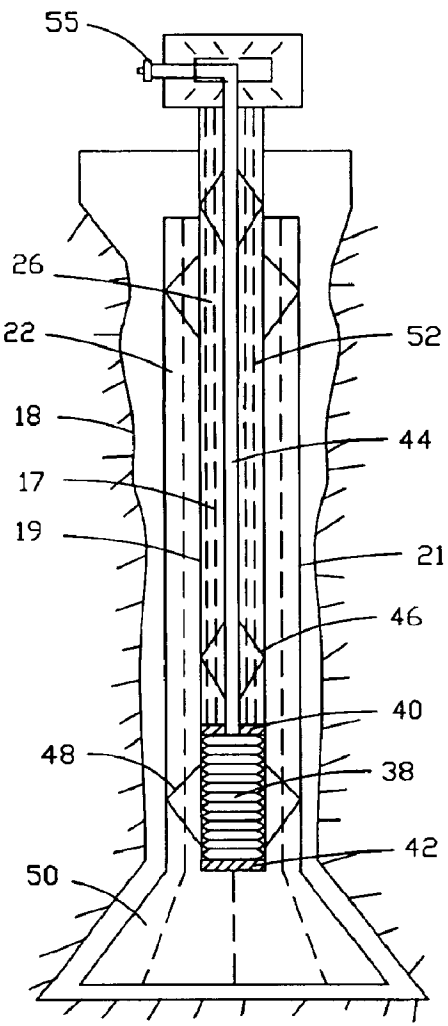
FIG. 5A is an elevational view, partially in section, that shows one embodiment of a lifting piston assembly wherein the piston has begun movement with respect to the in-ground cylinder in accord with the present invention.
Figure 5B:
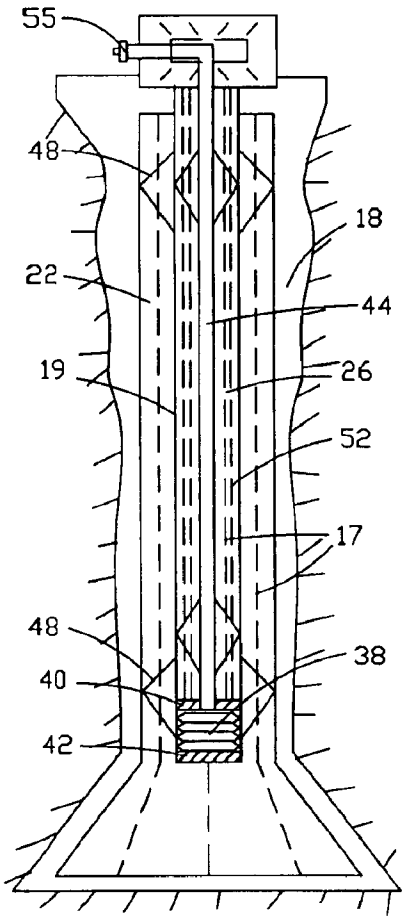
FIG. 5B is an elevational view, partially in section, that shows the embodiment of the lifting assembly of FIG. 5A prior to movement of the piston with respect to the in-ground cylinder.

In FIG. 5A, hydraulic fluid pressurizes chamber 38 to cause piston 26 to move with respect to cylinder 22. In FIG. 5B, the starting position of piston 26 with respect to cylinder 22 is shown. Fill line 55 attaches to a hydraulic source whereby hydraulic fluid is pumped through hydraulic line 44, which is now cemented into piston 26, to thereby produce pressure in sealed chamber 38 to actuate piston 26 movement.

Figure 6A:
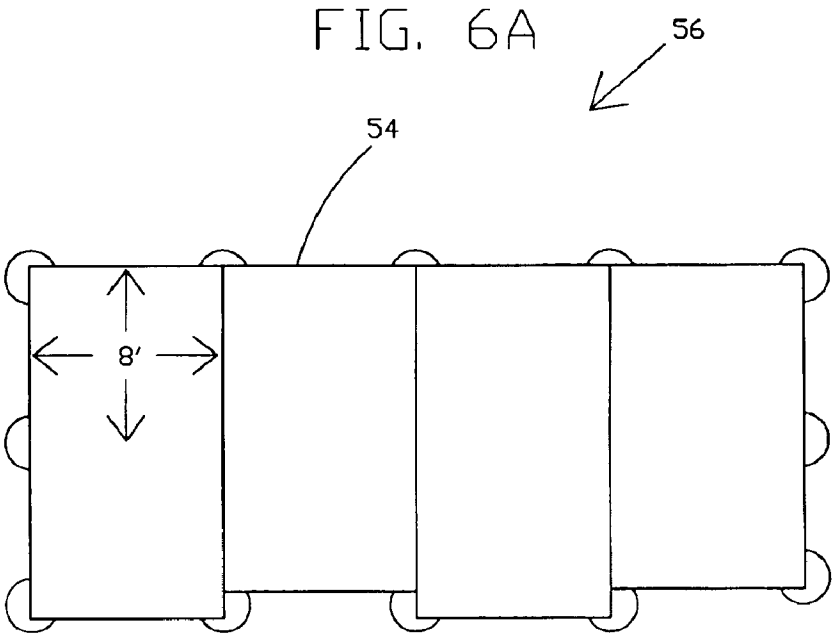
FIG. 6A is a plan view that shows a possible home foundation with and a perimeter lined with lifting piston assemblies in accord with the present invention.
Figure 6B:
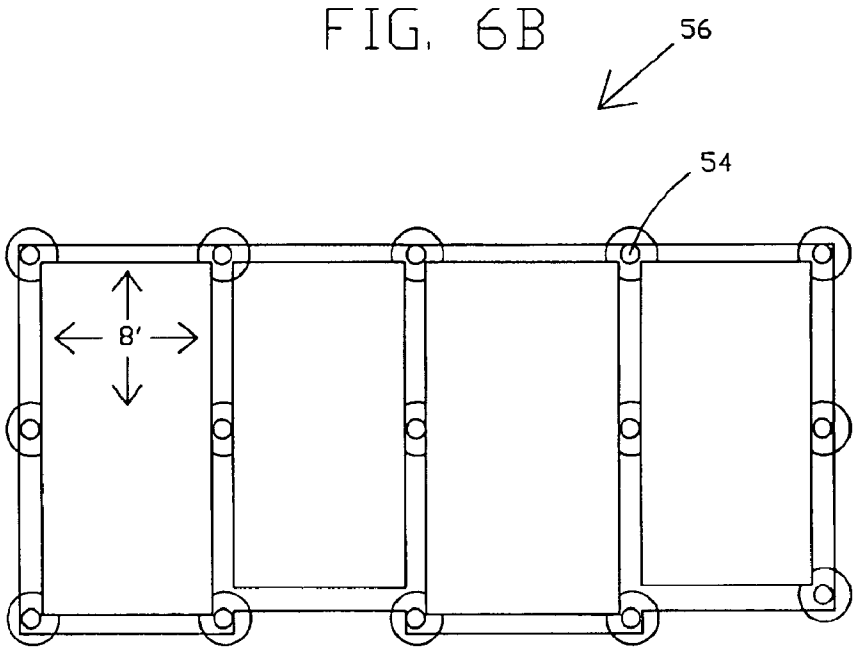
FIG. 6B is a plan view, partially in section, that shows the home foundation of FIG. 5A in section to reveal the placement of additional lifting piston assemblies in accord with the present invention.

FIG. 6A and FIG. 6B show that the piston assemblies are preferably formed on the gray beam 54 or strongest, thickest, portions of foundation 56. The piston assemblies may be spaced at a desired distance which may be selected to minimize bending stresses applied to foundation 56.

Figure 7:
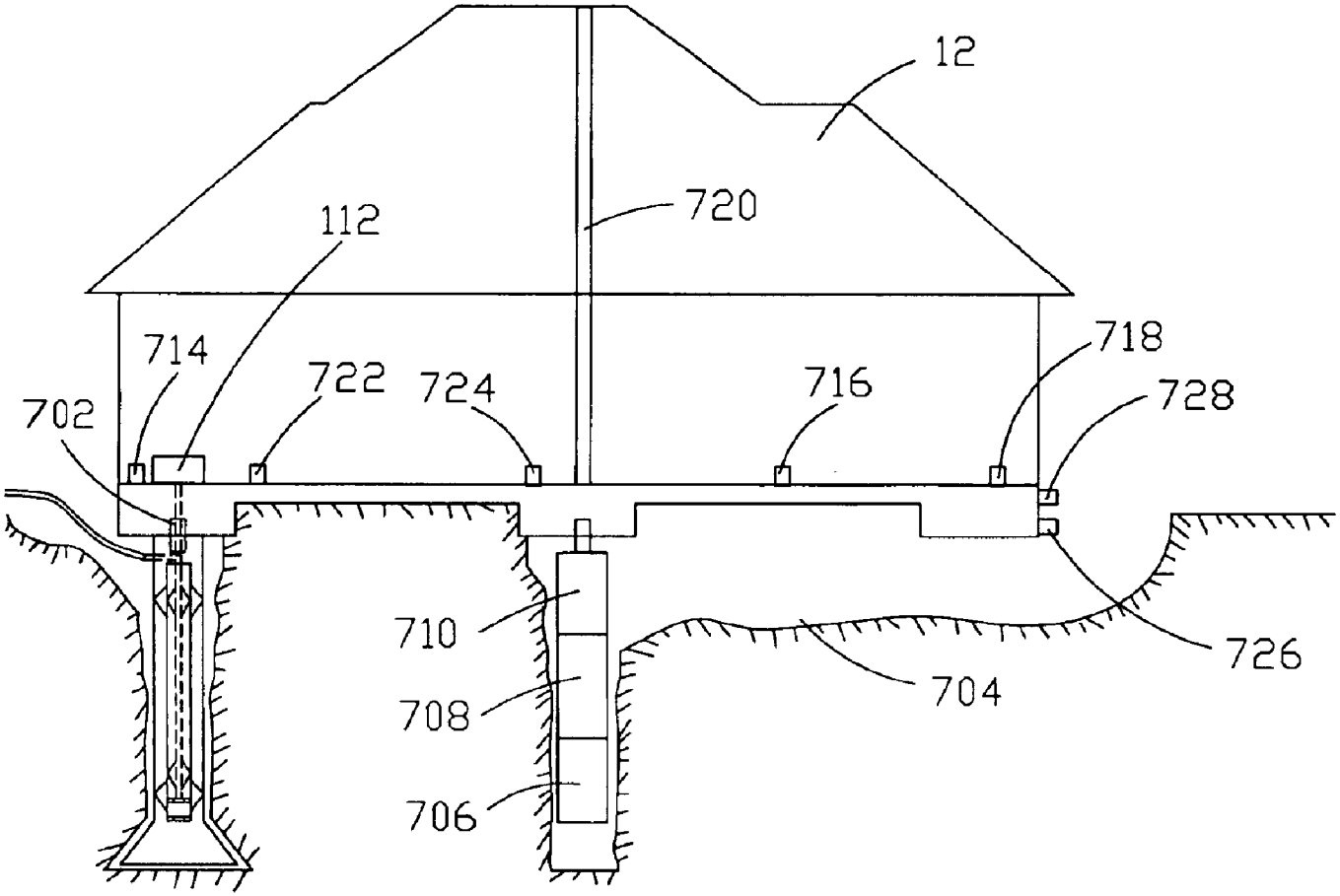
FIG. 7 is an elevational view, partially in section, showing other embodiments of a lifting piston assembly and methods of construction in accord with the present invention.
Figure 8:
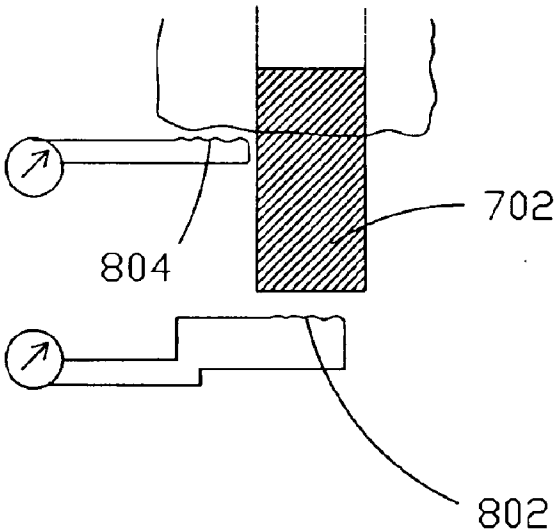
FIG. 8 is an elevational view, partially in section, showing a support pin secured to a house foundation in accord with the present invention.

FIG. 7 shows another embodiment of the piston assembly of the present invention. It will be seen in the corner piston assembly that an excavation is made and the piston assembly is built into the ground as discussed hereinbefore. In this embodiment, pin 702 may be installed or mounted to the foundation either from beneath the foundation or by drilling through the foundation. An enlargement of pin 702 is shown in FIG. 8. The enlargement shows that strain gages such as strain gage 802 and/or 804 may be utilized to measure the lifting force applied by each piston assembly. Pin 702 may also be used for other purposes such as permitting hanging of the liner to permit gravity to adjust the position thereof. Other means such as a plumb, laser alignment, or the like, may be utilized to orient the sleeve. If the sleeve is accurately positioned, then the piston and cylinder will automatically be oriented correctly. With lifts involving sizable lifts, e.g., ten feet or so, the accuracy of alignment of the sleeve becomes more critical and must be made more accurately. Note that the tunnels may be formed and piston assemblies positioned to support load bearing walls and foundation such as load bearing wall 720.

In order to install piston assemblies in interior positions, e.g., within the perimeter, the piston assembly will either need to be installed through the foundation or, as shown with tunnel 704, by tunneling under the foundation. If necessary, the sleeve may then need to be formed in sections such as sections 706, 708, and 710 or the tunnel made large enough so that the entire sleeve can be inserted in one piece. As the lifts become higher, the necessity for forming the sleeve in sections increases. For this purpose, the sleeves may include sockets for receiving/gluing, and the like.

While FIG. 8 showed strain gage 802 and 804 beneath the foundation, if pin 702 is installed through the foundation, then strain gage housing 712 above the foundation may be utilized, and/or removed when desired, to measure the lifting forces supplied by the piston assembly. As discussed above, barometric sensors may be utilized for measuring the relative height of the foundation such as sensors 714, 716, 718 and so forth. Laser detectors may also be utilized such as laser bending sensors 722 and 724. Other laser position sensors such as 726 and 728 may be utilized to measure the exact lifting distance, and/or to calibrate other elevation sensors.

Figure 9:
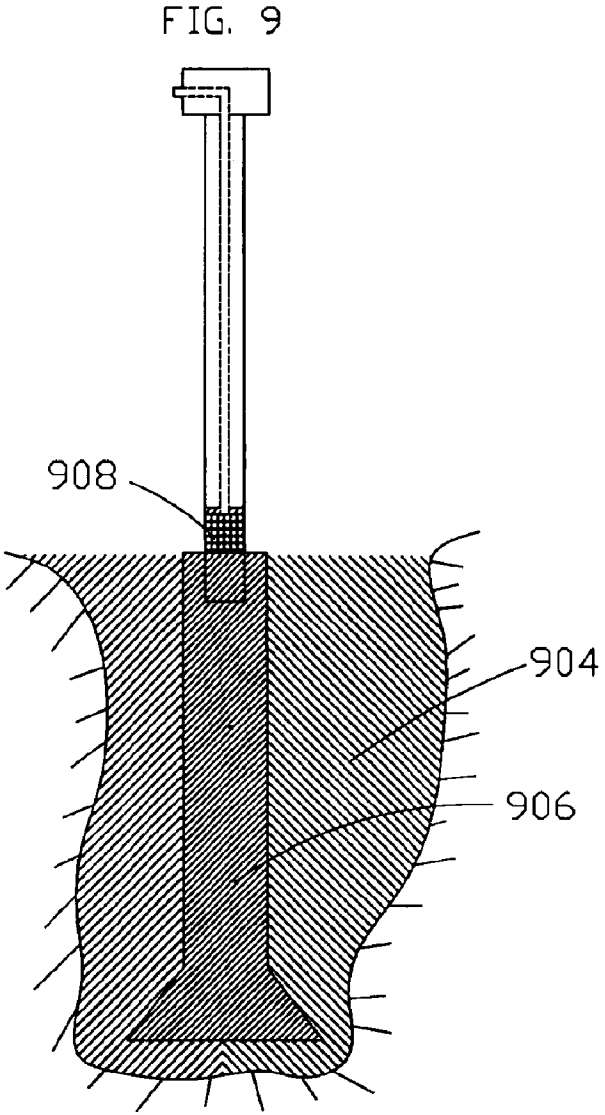
FIG. 9 is an elevational view, partially in section, showing a method whereby a first fluid that permanently solidifies is used for initial lifting and glass beads are utilized for fine adjustments that may be varied at any time in the future without the need to keep pressure on the piston seals.

FIG. 9 illustrates another method of the invention. While it is known to use glass beads or particulates, as first disclosed in my previous applications referred to herein to provide future adjustments, the cost of such beads to fill the entire volume of the piston assembly cavity during opening may be quite high. Therefore, in accord with the present invention, a hardenable material may be utilized to permanently affix piston 902 above cylinder housing 904 within volume 906. This material may be utilized for initial lifting, or may be recycled at a later time. The remaining portion of support material within the piston assembly may be glass beads, or other suitable particulates 908. In this way, the beads can be added or removed at any time after installation to level the building in the case of shifting soil, without the expense of utilizing the beads exclusively. For instance, beads may be added when a mixture of fluid contain the beads is pumped into the cylinder and a filter permits the fluid to exist but retains the beads. For removal, fluid may be pumped in and the beads may be permitted to flow out with the fluid. The beads will support the structure once the pressure is released, assuming the beads are retained within the piston cylinder by means such as a filter, or other means, so that the O-rings are not required after the desired position is determined.

Figure 10:
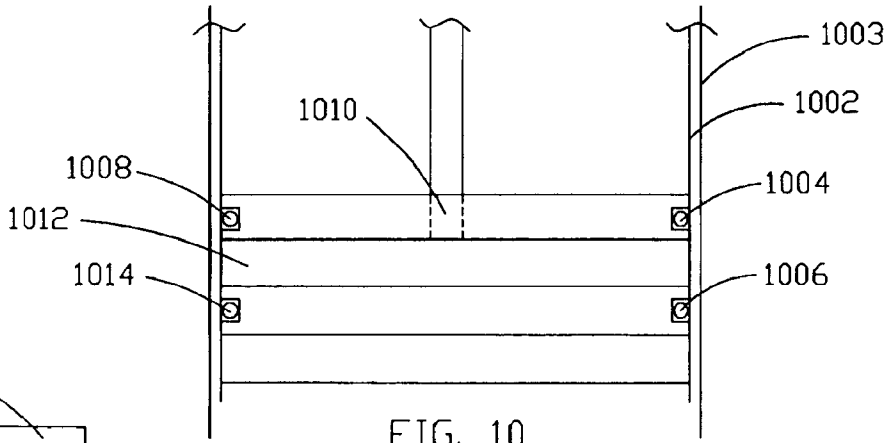
FIG. 10 is an elevational view, in section, showing a fiberglass sleeve and seal members for a piston assembly prior to adding cement in accord with the invention.

FIG. 10 shows an enlarged view of membrane 1002 (referred to earlier as membrane 52), liner 1003 (referred to as the sleeve or inner cylinder liner 19), piston seal 1004, and cylinder seal 1006. Liner 1003 may be a wound fiberglass sleeve or other suitable sleeve. Membrane 1002 is plastic or other impermeable material. Preferably membrane 1002 may be a suitable flexible plastic wrap material that is simply inserted into cylinder liner 1003 to prevent cement from physically contacting the inside surface of liner 1003. Alternatively, membrane 1002 could comprise a separate sleeve or the like. The purpose is to prevent cement physically contacting the inner surface of liner 1003. Especially in longer piston assemblies, e.g., from three to ten feet, this physical contact may score the inner surface of liner 1003. Piston seal 1004 may comprise a metal plate cut for O-ring seals 1008. Piston seal has hole 1010 formed therein to permit hydraulic lifting fluid, of various types as discussed above, to enter and expand chamber 1012 during operation. Cylinder seal 1006 also preferably provides O-ring seals 1014. Thus, cement within sleeve 1002 above seal 1004 forms the piston. Cement outside of sleeve 1002 and below seal 1006 forms the cylinder.

Figure 11:
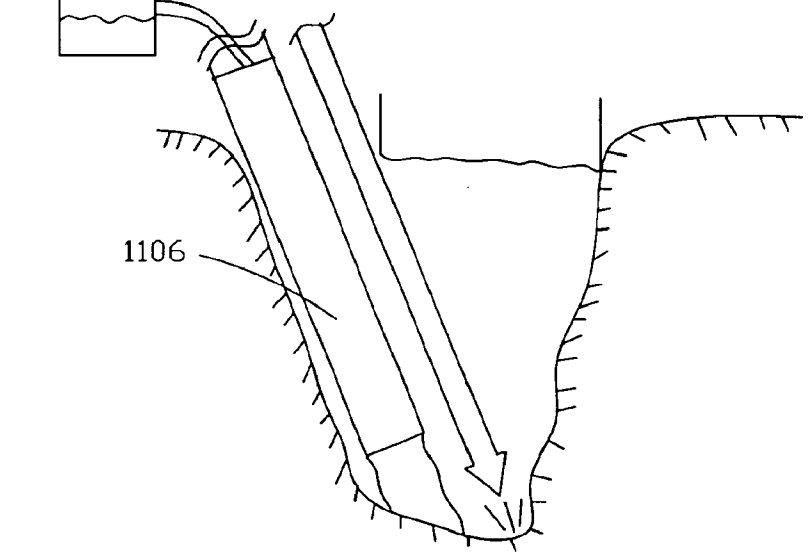
FIG. 11 is an elevational view, showing a hydro-excavation apparatus as one possible means for removing material from underneath a foundation in accord with the present invention.

FIG. 11 is one possible embodiment of a hydro-excavation means in accord with the present invention. One or more cutting jets 1102, which may be separate operated by wand 1104, may be mounted to the sleeve (not shown), may be mounted to suction hose 1106 or the like may be utilized to remove soil. In the present case, the hose (not shown full size) goes to storage tank 1108 whereby the soil may be already contained for transport, or relocation of the worksite, thereby saving time working with soil transport. Hydro-excavation may operate rather rapidly to create the various excavations needed.

The foregoing disclosure and description of the invention is therefore illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention. For instance, the present invention utilizes only one sleeve for forming both a piston and a cylinder. If desired, additional sleeves could be utilized, for instance, to further define the cylinder. Thus, the addition of more sleeves, hydraulic lines, seals, and the like is well within the concept of creating a piston cylinder beneath the foundation. Moreover, piston cylinder components or portions thereof could be machined and inserted, probably in sections, into the excavations to create the piston cylinder assemblies therein, and preferably cemented in position. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be different from that shown and still operate well within the spirit of the invention as described hereinbefore and in the appended claims. It will therefore be clearly seen that various changes and alternatives may be used that are contained within the spirit of the invention. Moreover, it will be understood that various directions such as "upper," "lower," "bottom," "top," "left," "right," "inwardly," "outwardly," and so forth are made only with respect to easier explanation in conjunction with the drawings and that the components may be oriented differently, for instance, during transportation and manufacturing as well as operation. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed:

1. An in-ground method for lifting a structure, said structure having a foundation, said foundation being supported by soil, said method comprising:

forming a plurality of spaced excavations underneath said foundation;

mounting at least one form in each of said plurality of excavations;

positioning hardenable material in a fluid state into said forms in said plurality of excavations to thereby form a plurality of piston assemblies within said excavations, each piston assembly comprising at least one piston comprised of said hardenable material in a fluid state which then hardens from said fluid state to form said at least one piston and at least one cylinder comprised of said hardenable material in a fluid state which then hardens from said fluid state to form said at least one cylinder, said at least one piston and said at least one cylinder being moveable with respect to each other; and pumping fluid into said plurality of piston assemblies to lift said structure and said foundation with respect to said soil.

2. The method of claim 1, wherein said excavations are formed with a hydro-excavator.

3. The method of claim 1, wherein said fluid pumped may comprise hardenable material.

4. The method of claim 1, further comprising permanently affixing said at least one piston in position with respect to said at least one cylinder for said plurality of piston assemblies within a range whereby a height of said foundation is adjustable within a range of movement after said structure is lifted.

5. The method of claim 4, further comprising partially filling a piston cylinder cavity with hardenable material.

6. The method of claim 5, further comprising filling a portion of said piston cylinder cavity with particles that can be removed from or added to said piston cylinder at a time after lifting.

7. The method of claim 1, further comprising monitoring a plurality of sensors while lifting said structure to minimize stresses on said foundation.

8. The method of claim 1, wherein the form is a non-metallic sleeve.

9. The method of claim 8, wherein seals are inserted into the non-metallic sleeve.

10. An in-ground system for lifting a structure, said structure having a foundation, said foundation being supported by soil, said system comprising:

a plurality of piston assemblies, said plurality of piston assemblies being positioned within excavations beneath said structure;

each piston assembly comprising, at least one piston cylinder for each of said plurality of piston assemblies, said at least one piston cylinder being formed from hardenable material that is in a fluid state when positioned in said excavation, and at least one piston for each of said plurality of piston assemblies, said at least one piston being formed from hardenable material that is in a fluid state when positioned in said excavation, said at least one piston being formed internally of said at least one piston cylinder; and at least one fluid line for pumping fluid for each of said plurality of piston assemblies.

11. The system of claim 10, further comprising:

at least one sleeve for each of said plurality of piston assemblies, said sleeve being mounted within said excavation whereby hardenable material may be poured outside said at least one sleeve to form said at least one piston cylinder, and hardenable material may be poured inside said sleeve to form said at least one piston.

12. An in-ground method for lifting a structure, said structure having a foundation, said foundation being supported by soil, said method comprising:

forming a plurality of piston assemblies beneath said foundation, each piston assembly comprising a piston and a cylinder such that said piston is positioned inside said cylinder, said piston and said cylinder being relatively moveable with respect to each other, at least said piston being formed by positioning liquid material which hardens below said foundation such that said piston is formed below said foundation for permanently supporting said foundation, each piston assembly having a length sufficient to lift said structure more than three feet whereby said piston and cylinder are relatively moveable with respect to each other by more than three feet; and operating said plurality of piston assemblies simultaneously to lift said foundation and said structure more than three feet with respect to said soil.

13. An in-ground piston assembly for lifting a structure, said structure having a foundation, said foundation being supported by soil, an excavation being formed beneath said structure, said in-ground piston assembly comprising:

a first sleeve mounted within said excavation beneath said structure;

an impermeable membrane initially positioned within said first sleeve prior to operation of said in-ground piston assembly;

a piston being comprised of hardenable material, said impermeable membrane preventing contact between an internal surface of said first sleeve and said hardenable material of said piston as said hardenable material hardens; and a cylinder formed outside said sleeve, said cylinder being comprised of hardenable material positioned outside said sleeve.

14. The in-ground piston assembly of claim 13, further comprising a second sleeve, said cylinder being positioned between said first sleeve and said second sleeve.

15. The in-ground piston assembly of claim 13, further comprising seals within said cylinder to provide a sealed pressure chamber within said cylinder whereby sufficient pressure within said pressure chamber moves said piston with respect to said cylinder.

16. The in-ground piston assembly of claim 15, further comprising a hydraulic line to said pressure chamber.

17. The in-ground piston assembly of claim 15, further comprising a hardenable hydraulic fluid pumpable into said pressure chamber which hardens after usage to maintain said piston in an extended position with respect to said cylinder.

* * * * *